US010953656B2

(12) United States Patent
Watanabe et al.

(10) Patent No.: US 10,953,656 B2
(45) Date of Patent: Mar. 23, 2021

(54) LIQUID DISCHARGE HEAD, LIQUID DISCHARGE DEVICE, AND LIQUID DISCHARGE APPARATUS

(71) Applicants: Yasuhiro Watanabe, Telford (GB); Norimasa Sohgawa, Kanagawa (JP)

(72) Inventors: Yasuhiro Watanabe, Telford (GB); Norimasa Sohgawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 38 days.

(21) Appl. No.: 16/269,601

(22) Filed: Feb. 7, 2019

(65) Prior Publication Data

US 2019/0270308 A1 Sep. 5, 2019

(30) Foreign Application Priority Data

Mar. 4, 2018 (JP) ..... JP2018-038128

(51) Int. Cl.
*B41J 2/14* (2006.01)

(52) U.S. Cl.
CPC ..... *B41J 2/1433* (2013.01)

(58) Field of Classification Search
CPC ..... B41J 2/1433
See application file for complete search history.

(56) References Cited

U.S. PATENT DOCUMENTS

2008/0143793 A1 6/2008 Okuda
2011/0069118 A1 3/2011 Ohzeki et al.
2013/0208059 A1 8/2013 Arimoto
2015/0062255 A1 3/2015 Sasaki
2016/0185113 A1* 6/2016 Yoshida ..... B41J 2/14233 347/47
2017/0120602 A1 5/2017 Nakai et al.
2017/0297333 A1 10/2017 Kohda et al.
2018/0072066 A1 3/2018 Yoneta
2019/0143680 A1* 5/2019 Yamamura ..... B41J 2/14209 347/47

FOREIGN PATENT DOCUMENTS

JP 9-141890 6/1997
JP 2010-214847 9/2010
JP 2011-212896 10/2011
JP 2012-011629 1/2012
JP 2013-176914 9/2013
JP 2014-210373 11/2014
JP 2015-036238 2/2015
JP 2017-077643 4/2017

* cited by examiner

*Primary Examiner* — Matthew Luu
*Assistant Examiner* — Kendrick X Liu
(74) *Attorney, Agent, or Firm* — Oblon, McClelland, Maier & Neustadt, L.L.P.

(57) ABSTRACT

A liquid discharge head includes a nozzle plate including a plurality of nozzles to discharge liquid, a plurality of individual chambers communicating with the plurality of nozzles, respectively, a supply-side channel communicating with the plurality of individual chambers, and a collection-side channel communicating with the plurality of individual chambers. The collection-side channel includes a first channel arranged in a first direction along a surface of the nozzle plate, a second channel communicating with the first channel, the second channel arranged in a second direction across the surface of the nozzle plate, and a branch channel branched from the first channel and connected to the second channel, the branch channel arranged in a third direction across the surface of the nozzle plate.

10 Claims, 9 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-038128, filed on Mar. 4, 2018, in the Japan Patent Office, the entire disclosure of which is incorporated by reference herein.

BACKGROUND

Technical Field

The present disclosure relates to a liquid discharge head, a liquid discharge device, and a liquid discharge apparatus.

Related Art

An individual-chamber circulation-type head that circulates liquid through an individual chamber, has been known as a liquid discharge head that discharges liquid.

A common-channel circulation-type head has been known, in which provided is a channel linking the upstream side of a supply port of a common channel communicating with a plurality of nozzles and the downstream side of a collection port of the common channel.

SUMMARY

In an aspect of this disclosure, a novel liquid discharge head includes a nozzle plate including a plurality of nozzles to discharge liquid, a plurality of individual chambers communicating with the plurality of nozzles, respectively, a supply-side channel communicating with the plurality of individual chambers, and a collection-side channel communicating with the plurality of individual chambers. The collection-side channel includes a first channel arranged in a first direction along a surface of the nozzle plate, a second channel communicating with the first channel, the second channel arranged in a second direction across the surface of the nozzle plate, and a branch channel branched from the first channel and connected to the second channel, the branch channel arranged in a third direction across the surface of the nozzle plate.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
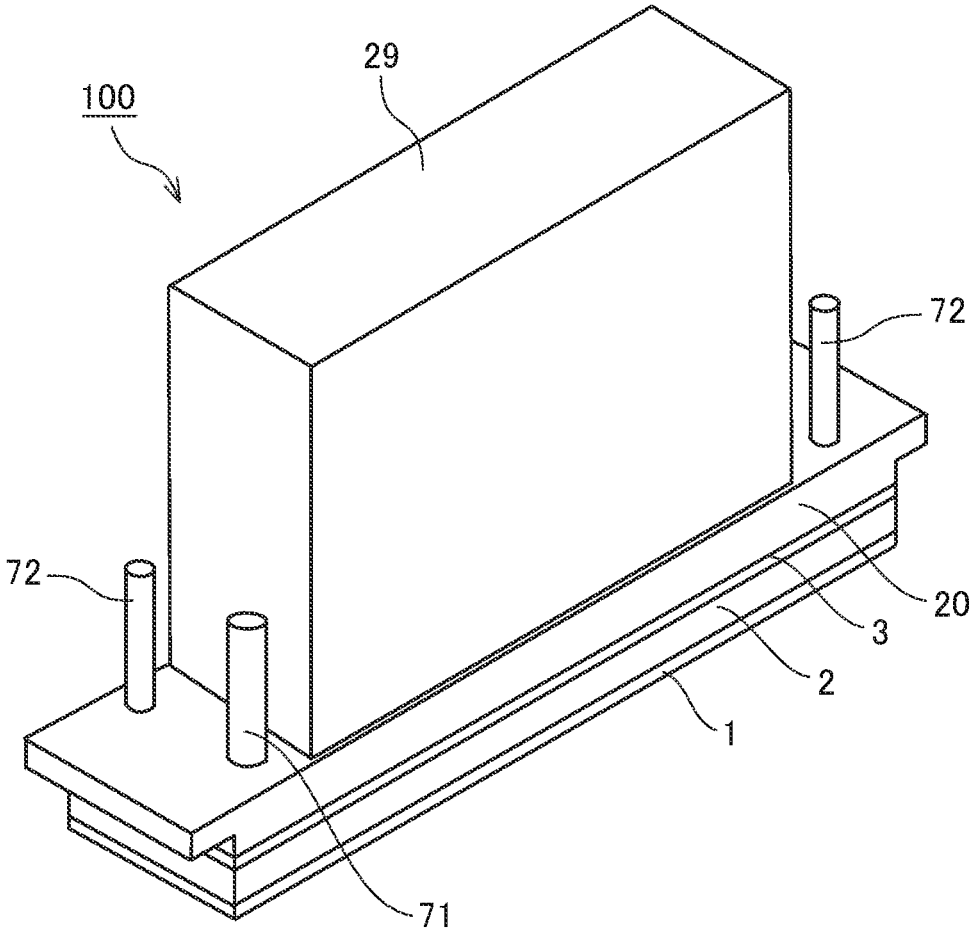
FIG. 1 is an explanatory perspective external view of an exemplary liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
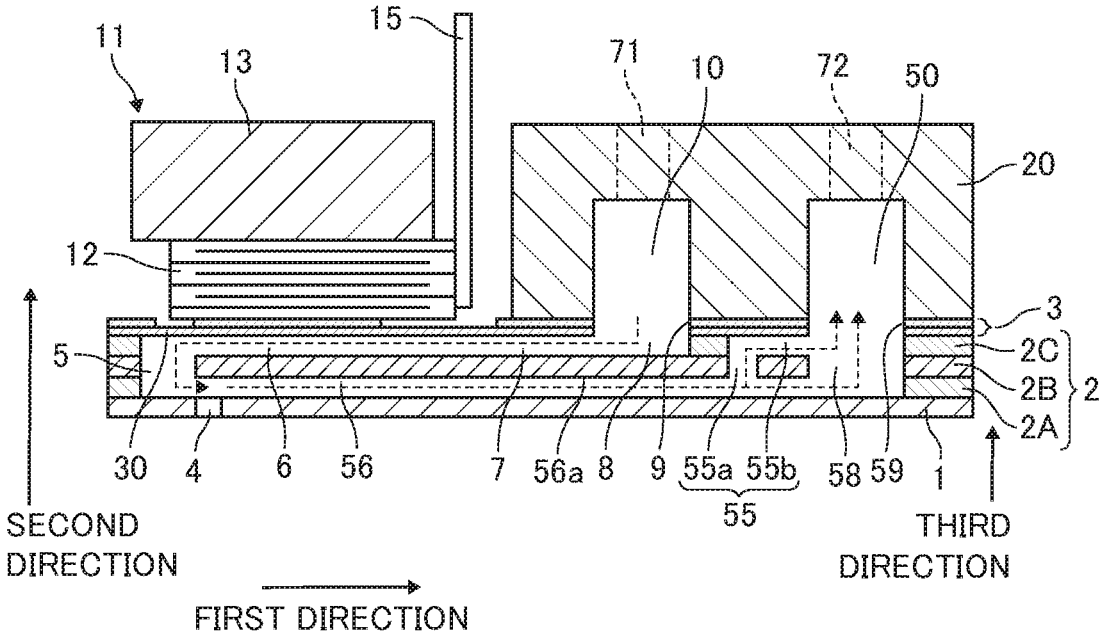
FIG. 2 is an explanatory cross-sectional view of the liquid discharge head in a direction orthogonal to the nozzle arranged direction of the liquid discharge head.

Embodiments of the present disclosure will be described below with reference to the accompanying drawings. A first embodiment of the present disclosure will be described with reference to FIGS. 1 and 2. FIG. 1 is an explanatory perspective external view of a liquid discharge head 100 according to the embodiment. FIG. 2 is an explanatory cross-sectional view of the liquid discharge head 100 in a direction orthogonal to the nozzle arranged direction of the liquid discharge head.

Hereinafter, the "liquid discharge head" is simply referred to as the "head".

The head 100 includes a nozzle plate 1, a channel plate 2, and a diaphragm member 3 as a wall-face member that are laminated one on another and bonded to each other. The head 100 includes a piezoelectric actuator 11 that displaces an oscillation region 30 (diaphragm) of the diaphragm member 3, a common channel member 20 doubling as a frame member of the head, and a cover member 29.

The nozzle plate 1 has a plurality of nozzles 4 that discharges liquid.

The channel plate 2 forms a plurality of individual chambers 6 communicating with the plurality of nozzles 4 through respective nozzle communicating passages 5, a plurality of supply-side fluid-resistance parts 7 communicating with the plurality of individual chambers 6 mutually, and at least one supply-side liquid inlet part 8 communicating with at least one of the supply-side fluid-resistance parts 7. The supply-side liquid inlet part 8 communicates with a supply-side common channel 10 through a supply-side opening 9 of the diaphragm member 3. Note that, in the present embodiment, the channel plate 2 includes a plurality of plate-shaped members 2A to 2C in layers.

In the present embodiment, a supply-side channel includes the supply-side fluid-resistance parts 7, the supply-side liquid inlet part 8, the supply-side opening 9, and the supply-side common channel 10.

The diaphragm member 3 has the oscillation region 30 that is deformable and forms the wall faces of the individual chambers 6 of the channel plate 2. Here, the diaphragm member 3 has (but not limited to) a double-layer structure including a second layer forming a thick wall on a first layer forming a thin wall on the channel plate 2 side. The first layer forms the deformable oscillation region 30 at portions corresponding to the individual chambers 6.

The piezoelectric actuator 11 is disposed on the opposite side to the individual chambers 6 with respect to the diaphragm member 3, the piezoelectric actuator 11 including an electromechanical conversion element serving as a driver (an actuator or a pressure generator) that deforms the oscillation region 30 of the diaphragm member 3.

The piezoelectric actuator 11 includes a required number of columnar piezoelectric elements 12 at predetermined intervals in a comb shape, the columnar piezoelectric elements 12 including a piezoelectric member joined with a base member 13, subjected to groove processing by half-cut dicing. The piezoelectric elements 12 are joined to the oscillation region 30 (diaphragm) of the diaphragm member 3. A flexible wiring member 15 is connected to the piezoelectric elements 12.

The channel plate 2 forms: a plurality of individual collection channels 56 communicating with the plurality of individual chambers 6 through the respective nozzle communicating passages 5, the plurality of individual collection channels 56 arranged along a surface direction of the channel plate 2; and a collection-side liquid outlet part 58 communicating with at least one of the individual collection channels 56. The collection-side liquid outlet part 58 communicates with a collection-side common channel 50 through a collection-side opening 59 of the diaphragm member 3.

In the present embodiment, a collection-side channel includes the individual collection channels 56, the collection-side liquid outlet part 58, the collection-side opening 59, and the collection-side common channel 50.

Here, each of the individual collection channels 56 is a first channel arranged in a first direction along a surface (inner surface) of the channel plate 2.

The inner surface of the channel plate 2 is a surface of one of the plurality of plate-shaped members 2A to 2C inside the head 100.

A second channel includes the collection-side liquid outlet part 58, the collection-side opening 59, and the collection-side common channel 50. The second channel is arranged in a second direction across the surface (inner surface) of the channel plate 2.

It can be said that the second channel is arranged in a second direction across the surface (inner surface) of the nozzle plate 1 because the surface of the channel plate 2 is parallel to the surface of the nozzle plate 1.

Note that, although the second channel is arranged in the second direction orthogonal to the surface (inner surface) of the channel plate 2 as illustrated in FIG. 2 in the present embodiment, the second channel may be arranged obliquely to the surface (inner surface) of the channel plate 2.

The common channel member 20 forms: the supply-side common channel 10 that supplies the liquid to the plurality of individual chambers 6; and the collection-side common channel 50 with which the plurality of individual collection channels 56 communicates. The supply-side common channel 10 communicates with a supply port 71, and the collection-side common channel 50 communicates with a collection port 72.

In the head 100 having the configuration, for example, decreasing voltage to be applied to the piezoelectric elements 12 from reference potential (midpoint potential), causes the piezoelectric elements 12 to contract. Then, the oscillation region 30 of the diaphragm member 3 is pulled, so that the individual chambers 6 expand in capacity. Thus, the liquid flows into the individual chambers 6.

After that, increasing the voltage to be applied to the piezoelectric elements 12, causes the piezoelectric elements 12 to elongate in the layered direction. Then, the oscillation region 30 of the diaphragm member 3 deforms forward to the nozzles 4, to contract the individual chambers 6 in capacity. Then, the individual chambers 6 pressurize the liquid inside, so that the nozzles 4 discharge the liquid.

The liquid not discharged from the nozzles 4 passes by the nozzles 4, so as to be collected from the individual collection channels 56 to the collection-side common channel 50. Then, the liquid is supplied from the collection-side common channel 50 to the supply-side common channel 10 again through an external circulation channel.

Note that a method of driving the head is not limited to the example described above (pulling and pushing), and thus pulling or pushing can be performed depending on a method of giving a driving waveform.

Next, a branch channel in the first embodiment is described below.

The head 100 in the present embodiment includes a branch channel 55 communicating with the collection-side liquid outlet part 58 serving as the second channel.

The branch channel 55 is branched from an upper surface 56*a* of the individual collection channel 56 serving as the first channel.

The branch channel 55 includes: a first branch channel 55*a* arranged in the third direction to be connected to the upper surface 56*a* of the individual collection channel 56 and a second branch channel 55*b* to connect the first branch channel 55*a* and the second channel (collection-side liquid outlet part 58). Here, the first branch channel 55*a* is formed in the third direction orthogonal to the first direction along the surface of the channel plate 2, similarly to the collection-side liquid outlet part 58 (second channel). The second branch channel 55*b* is formed in the first direction along the surface (inner surface) of the channel plate 2.

It can be said that the first branch channel 55*a* is formed in the third direction orthogonal to the first direction along the surface of the nozzle plate 1, similarly to the collection-side liquid outlet part 58 (second channel) and the second branch channel 55*b* is formed in the first direction along the surface (inner surface) of the nozzle plate 1 because the surface of the channel plate 2 is parallel to the surface of the nozzle plate 1.

Thus, the collection-side channel includes a first channel (individual collection channels 56) arranged in a first direction along a surface of the nozzle plate 1, a second channel (the collection-side liquid outlet part 58) communicating with the first channel (individual collection channels 56), the second channel arranged in a second direction across the surface of the nozzle plate 1, and a branch channel 55 branched from the upper surface 56*a* of the first channel (individual collection channels 56) and connected to the second channel (the collection-side liquid outlet part 58), the branch channel 55 arranged in a third direction across the surface of the nozzle plate 1.

The branch channel 55 includes a first branch channel 55*a* arranged in the third direction to be connected to the first channel (individual collection channels 56) and a second branch channel 55*b* to connect the first branch channel 55*a* and the second channel (the collection-side liquid outlet part 58).

The second direction and the third direction are orthogonal to the first direction, and the second branch channel 55*b* is arranged in the first direction.

Figure 3:
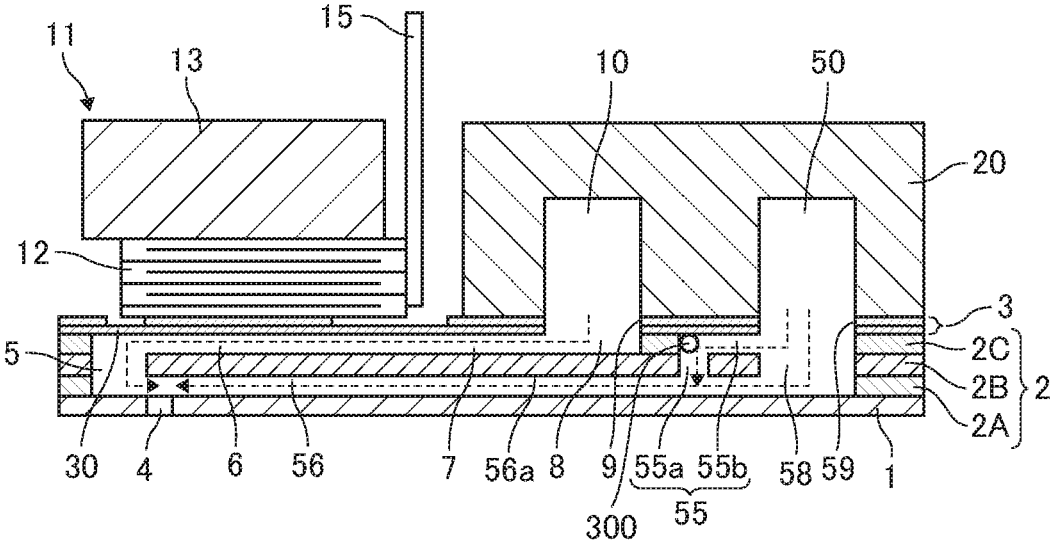
FIG. 3 is an explanatory cross-sectional view of the liquid discharge head along the direction orthogonal to the nozzle arranged direction, for describing the function of the embodiment.

Next, the function of the present embodiment will be described with reference to FIG. 3. FIG. 3 is an explanatory cross-sectional view of the head along the direction orthogonal to the nozzle arranged direction, for describing the function of the embodiment.

As described above, when driving the piezoelectric actuator 11 performs pressurization inside the individual chambers 6 to discharge the liquid from the nozzles 4, as illustrated in FIG. 3, there is a possibility that a counter flow occurs to the nozzle 4 from the collection-side common channel 50 through the collection-side liquid outlet part 58 and the individual collection channel 56.

At this time, when air 300 is included in the liquid flowing from the collection-side liquid outlet part 58 to the individual collection channel 56, the air 300 moves along the upper surface 56*a* of the individual collection channel 56.

Therefore, when the air 300 reaches the branch channel 55 opening at the upper surface 56*a* of the individual collection channel 56, the air 300 rises in the branch channel 55 due to buoyancy. When the counter flow disappears from the individual collection channel 56, the air 300 moves in the branch channel 55 and then returns into the collection-side liquid outlet part 58.

Therefore, the air 300 is inhibited from moving in proximity to the nozzle 4 due to the counterblow in liquid discharge, so that a discharge fault can be inhibited from occurring.

The branch channel 55 has a function of decreasing the fluid resistance of the individual collection channel 56. This arrangement enables the branch channel 55 to adjust a fluid resistance value in a case where the fluid resistance is high because the width of the individual collection channel 56 cannot be ensured sufficiently in a highly densified head.

Figure 4:
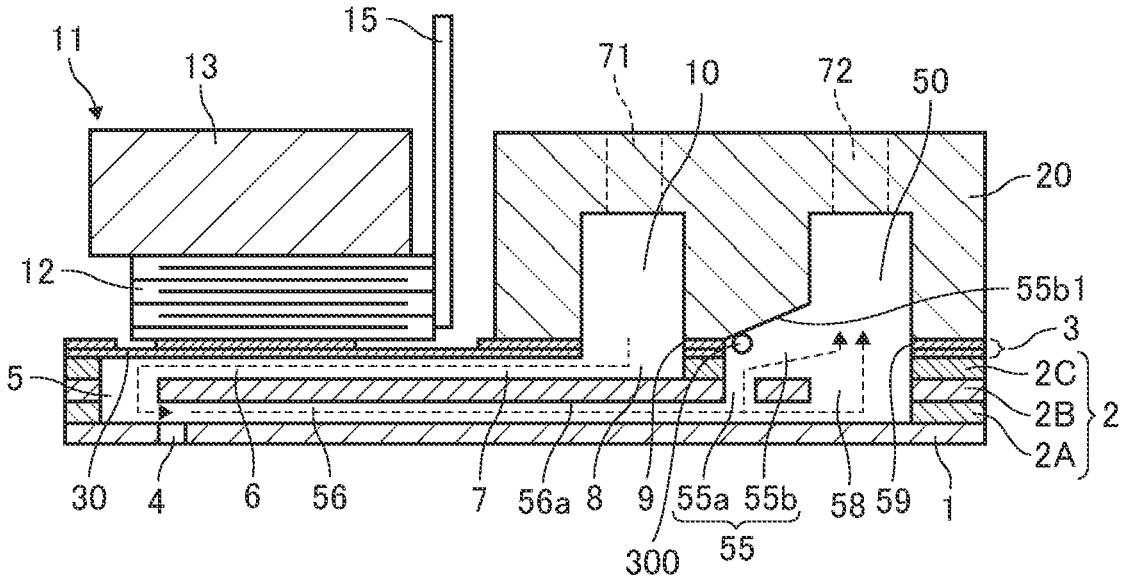
FIG. 4 is an explanatory cross-sectional view of a liquid discharge head according to a second embodiment of the present disclosure, along a direction orthogonal to the nozzle arranged direction of the liquid discharge head.

Next, a second embodiment of the present disclosure will be described with reference to FIG. 4. FIG. 4 is an explanatory cross-sectional view of a head according to the embodiment, along a direction orthogonal to the nozzle arranged direction of the head.

In the present embodiment, an upper surface of a second branch channel 55*b* of a branch channel 55 has an oblique face 55*b*1. In this case, the second branch channel 55*b* communicates between a first branch channel 55*a*, a collection-side liquid outlet part 58, a collection-side opening 59, and a collection-side common channel 50.

Thus, the second branch channel 55*b* has an upper surface inclined obliquely upward from the first branch channel 55*a* to the second channel (collection-side liquid outlet part 58).

The configuration allows air 300 taken into the branch channel 55, to move promptly to a second channel on the downstream side, in liquid circulation.

Figure 5:
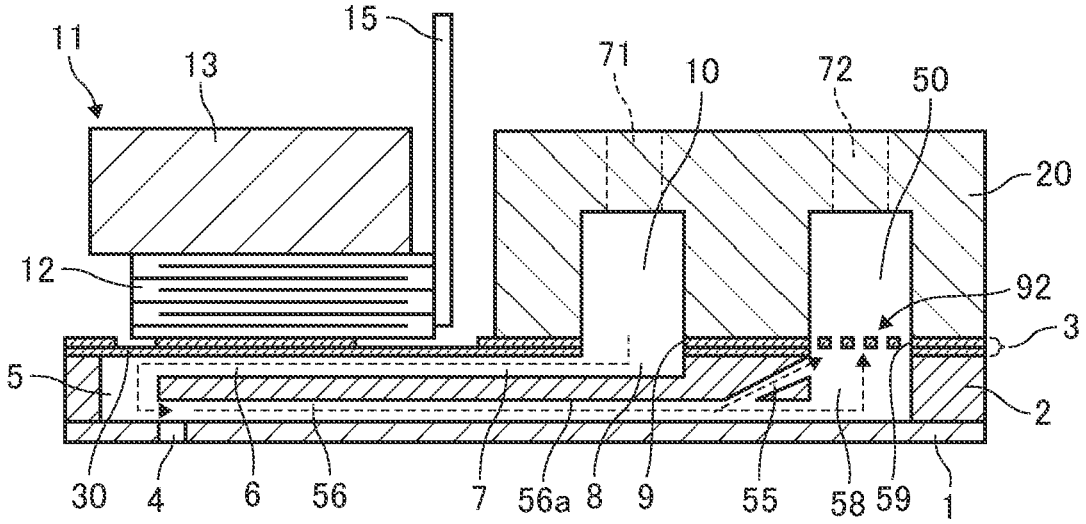
FIG. 5 is an explanatory cross-sectional view of a liquid discharge head according to a third embodiment of the present disclosure, along a direction orthogonal to the nozzle arranged direction of the liquid discharge head.

Next, a third embodiment of the present disclosure will be described with reference to FIG. 5. FIG. 5 is an explanatory cross-sectional view of a head according to the embodiment, along a direction orthogonal to the nozzle arranged direction of the head.

In the embodiment, a branch channel 55 communicates obliquely with a collection-side liquid outlet part 58, directly from an upper surface 56*a* of an individual collection channel 56. A collection-side filter 92 is provided between the collection-side liquid outlet part 58 and a collection-side common channel 50.

Thus, the branch channel 55 has the upper surface inclined obliquely upward from the upper surface 56*a* of the first channel (individual collection channel 56) to the second channel (collection-side liquid outlet part 58).

The configuration facilitates discharge of added air into the second channel side, similarly to the second embodiment. The air trapped by the collection-side filter 92 can be inhibited from counterflowing to the nozzle side.

Figure 6:
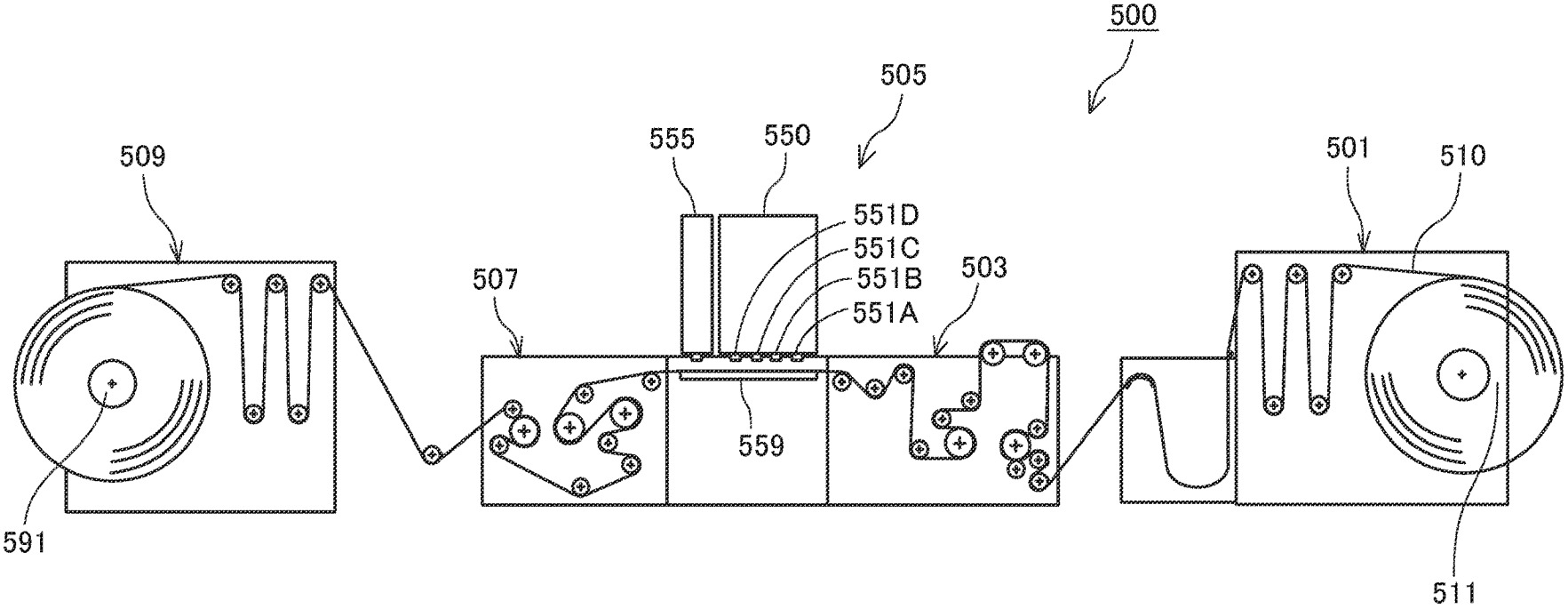
FIG. 6 is an explanatory schematic view of an exemplary liquid discharge apparatus according to the present disclosure.
Figure 7:
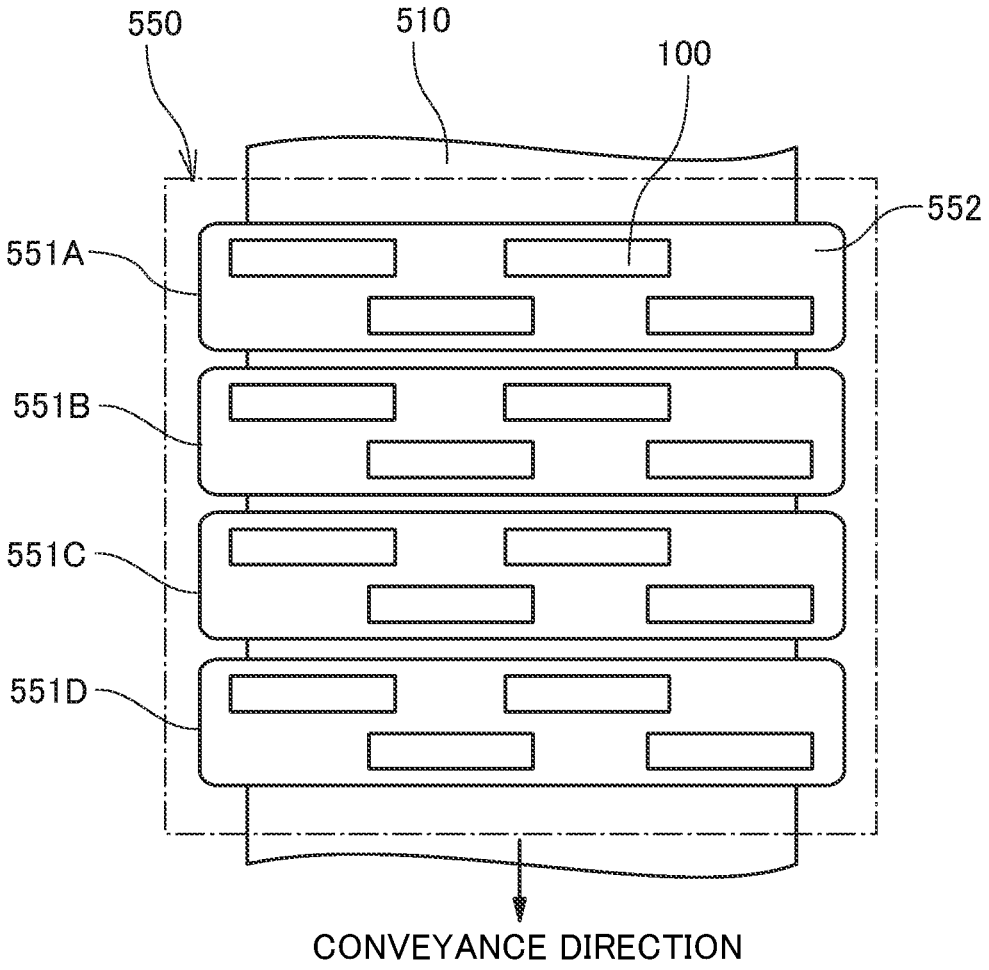
FIG. 7 is an explanatory plan view of an exemplary head unit of the liquid discharge apparatus.

Next, an exemplary liquid discharge apparatus according to the present disclosure, will be described with reference to FIGS. 6 and 7. FIG. 6 is an explanatory schematic view of the liquid discharge apparatus. FIG. 7 is an explanatory plan view of an exemplary head unit of the liquid discharge apparatus.

The printing apparatus 500 serving as the liquid discharge apparatus according to the present embodiment includes a feeder 501 to feed a continuous medium 510, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a first head unit 550 and a second head unit 555 on a conveyance guide 559. The first head unit 550 discharges liquid to form an image on the continuous medium 510. Post-treatment is performed on the continuous medium 510 with treatment liquid discharged from the second head unit 555.

Here, the first head unit 550 includes, for example, four-color full-line head arrays 551A, 551B, 551C, and 551D (hereinafter, collectively referred to as "head arrays 551" unless colors are distinguished) from an upstream side in a feed direction of the continuous medium 510 (hereinafter, "medium feed direction").

The head arrays 551A, 551B, 551C, and 551D are liquid dischargers to discharge liquid of black (K), cyan (C), magenta (M), and yellow (Y), respectively, onto the continuous medium 510. Note that the number and types of color are not limited to the above-described four colors of K, C, M, and Y and may be any other suitable number and types.

In each head array 551, for example, as illustrated in FIG. 7, a plurality of heads 100 (also referred to as simply "heads") are arranged in a staggered manner on a base 552 to form the head array 551. Note that the configuration of the head array 551 is not limited to such a configuration.

Figure 8:
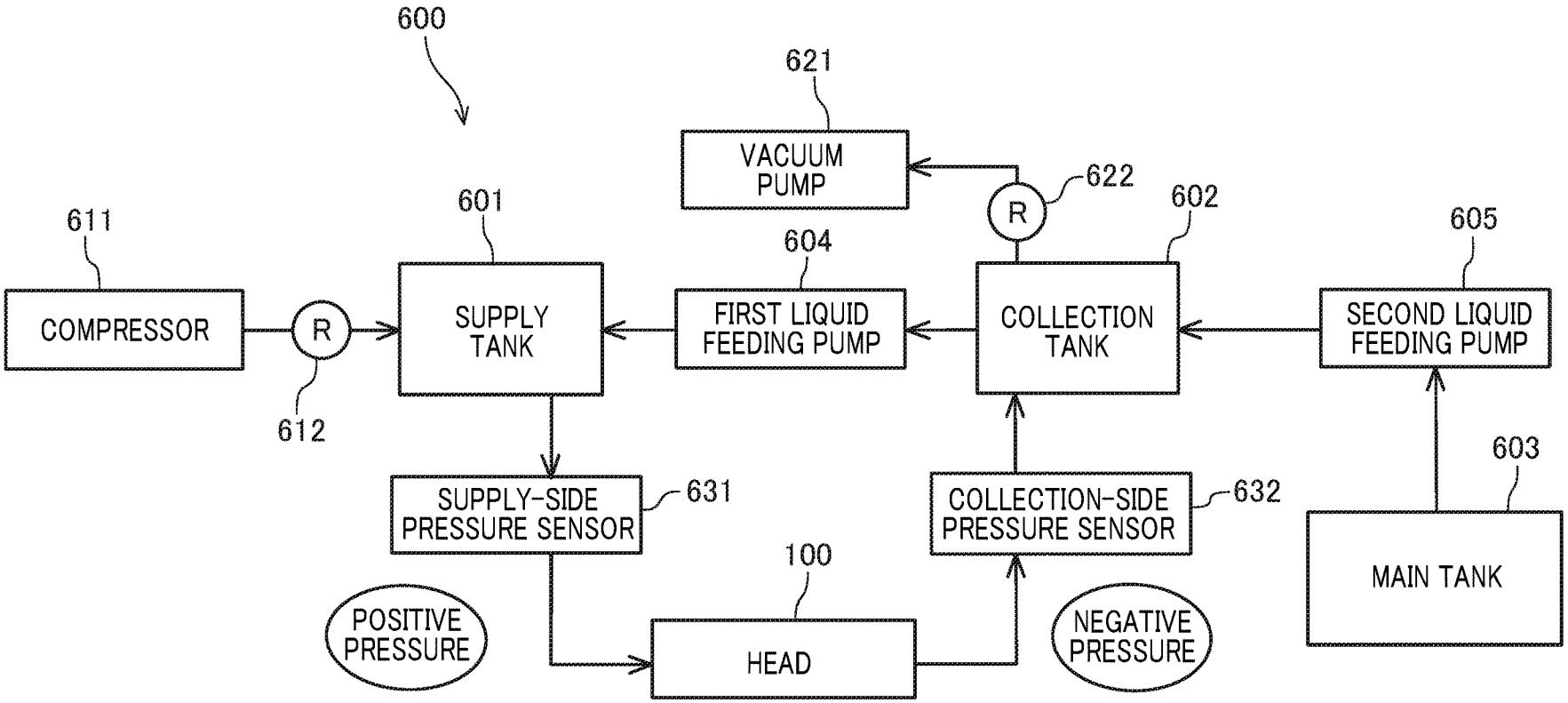
FIG. 8 is an explanatory block diagram of an exemplary liquid circulation device.

Next, an exemplary liquid circulation device will be described with reference to FIG. 8. FIG. 8 is an explanatory block diagram of the liquid circulation device. Note that, although only one head is illustrated here, in a case where a plurality of heads is arranged, supply-side liquid channels are connected to the supply side of the plurality of heads through a manifold, and collection-side liquid channels are connected to the collection side of the plurality of heads through a manifold.

A liquid circulation device 600 includes a supply tank 601, a collection tank 602, a main tank 603, a first liquid feeding pump 604, a second liquid feeding pump 605, a compressor 611, a regulator 612, a vacuum pump 621, a regulator 622, a supply-side pressure sensor 631, and a collection-side pressure sensor 632.

Here, the compressor 611 and the vacuum pump 621 generate a difference between pressure in the supply tank 601 and pressure in the collection tank 602.

The supply-side pressure sensor 631 located between the supply tank 601 and the head 100, is connected to the supply-side liquid channel linking with a supply port 71 of the head 100. The collection-side pressure sensor 632 located between the head 100 and the collection tank 602, is connected to the collection-side liquid channel linking with a collection port 72 of the head 100.

One end of the collection tank 602 is connected to the supply tank 601 through the first liquid feeding pump 604. The other end of the collection tank 602 is connected to the main tank 603 through the second liquid feeding pump 605.

This arrangement allows a circulation channel for circulating the liquid, in which the liquid flowed from the supply tank 601 into the head 100 through the supply port 71, is collected from the collection port 72 to the collection tank 602, and the first liquid feeding pump 604 feeds the liquid from the collection tank 602 to the supply tank 601.

Here, the supply tank 601 linked with the compressor 611, is controlled such that the supply-side pressure sensor 631 detects predetermined positive pressure. Meanwhile, the collection tank 602 linked with the vacuum pump 621, is controlled such that the collection-side pressure sensor 632 detects predetermined negative pressure.

This arrangement enables the liquid to circulate through the head 100 with the negative pressure of meniscus retained constant.

When the liquid is discharged from the nozzles 4 of the head 100, the amount of the liquid decreases in each of the supply tank 601 and the collection tank 602. Thus, the liquid is appropriately replenished from the main tank 603 to the collection tank 602 with the second liquid feeding pump 605.

Note that the timing of liquid replenishment from the main tank 603 to the collection tank 602, can be controlled on the basis of a detected result of a level sensor provided in the collection tank 602, for example, when the level of the liquid in the collection tank 602 falls below a predetermined height.

Figure 9:
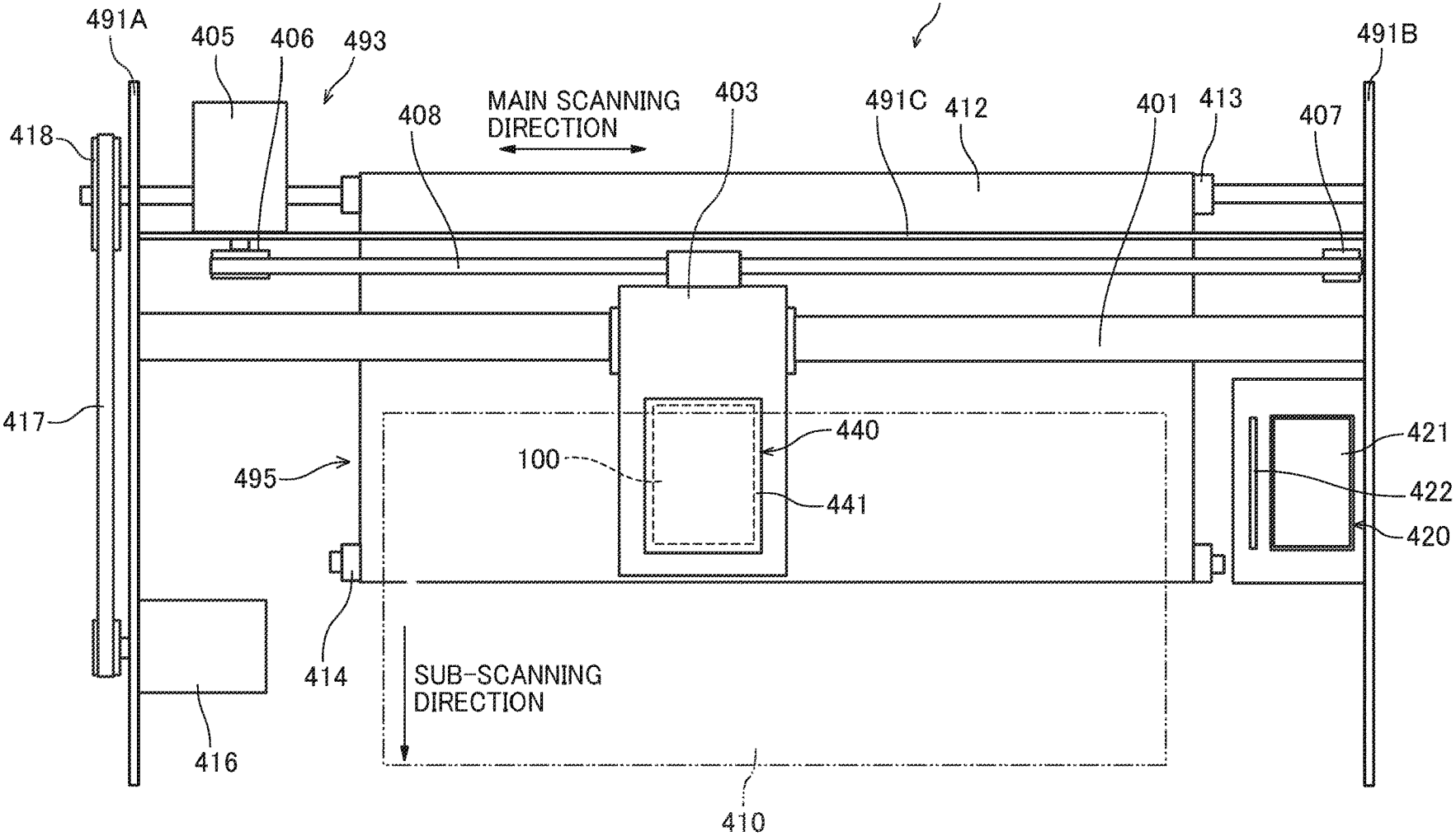
FIG. 9 is an explanatory plan view of a main part of another exemplary liquid discharge apparatus according to the present disclosure.
Figure 10:
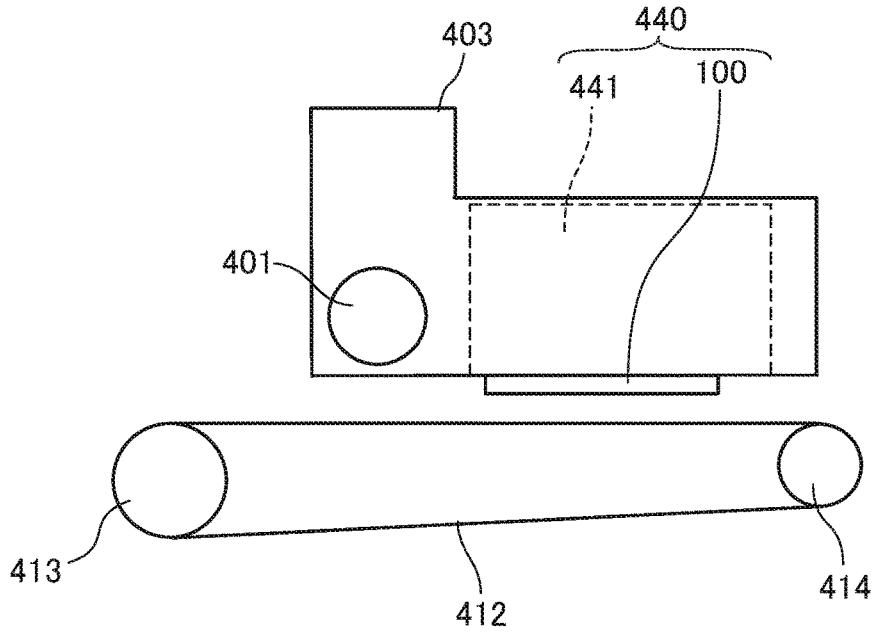
FIG. 10 is an explanatory side view of the main part of the liquid discharge apparatus.

Next, a printing apparatus that is another exemplary liquid discharge apparatus according to the present disclosure, will be described with reference to FIGS. 9 and 10. FIG. 9 is an explanatory plan view of a main part of the printing apparatus. FIG. 10 is an explanatory side view of the main part of the printing apparatus.

A printing apparatus 500 that is a serial head apparatus, reciprocates a carriage 403 in a main scanning direction with a main scanning movement mechanism 493. The main scanning movement mechanism 493 includes a guide member 401, a main scanning motor 405, and a timing belt 408. The guide member 401 bridged across a left side plate 491A and a right side plate 491B, retains the carriage 403 movably. The main scanning motor 405 reciprocates the carriage 403 in the main scanning direction through the timing belt 408 stretched across a driving pulley 406 and a driven pulley 407.

The carriage 403 is equipped with a liquid discharge device 440 including a head 100 according to the present disclosure integrally formed with a head tank 441. The head 100 of the liquid discharge device 440, discharges liquids for respective colors of yellow (Y), cyan (C), magenta (M), and black (K). The head 100 includes a nozzle array including a plurality of nozzles disposed in the sub-scanning direction orthogonal to the main scanning direction, the discharge direction of the nozzles facing downward.

The head 100 is circulation-supplied with the liquid for a required color in connection with the liquid circulation device 600 described above.

The printing apparatus 500 includes a conveyance mechanism 495 that conveys a paper sheet 410. The conveyance mechanism 495 includes a conveyance belt 412 that is a conveyer and a sub-scanning motor 416 that drives the conveyance belt 412.

The conveyance belt 412 adsorbs and conveys the paper sheet 410 at a position opposed to the head 100. The conveyance belt 412 that is an endless belt, is stretched across a conveyance roller 413 and a tension roller 414. The adsorption can be performed by electrostatic adsorption or air suction.

When the sub-scanning motor 416 drives the conveyance roller 413 to rotate through a timing belt 417 and a timing pulley 418, the conveyance belt 412 moves circumferentially in the sub-scanning direction.

Furthermore, a maintenance mechanism 420 that maintains the head 100, is disposed laterally to the conveyance belt 412, on one side in the main scanning direction of the carriage 403.

For example, the maintenance mechanism 420 includes a cap member 421 that caps the nozzle face of the head 100 (face on which the nozzles are formed) and a wiper member 422 that wipes the nozzle face.

The main scanning movement mechanism 493, the maintenance mechanism 420, and the conveyance mechanism 495 are attached to a casing including the side plates 491A and 491B and a back plate 491C.

In the printing apparatus 500 having the configuration, the paper sheet 410 is fed and adsorbed onto the conveyance belt 412. Then, the conveyance belt 412 moves circumferentially to convey the paper sheet 410 in the sub-scanning direction.

The head 100 is driven in accordance with an image signal while the carriage 403 is moving in the main scanning direction. Thus, the liquid is discharged onto the paper sheet 410 stopping to form an image.

Thus, because including the head according to the present disclosure, the apparatus can form a high-quality image reliably.

Figure 11:
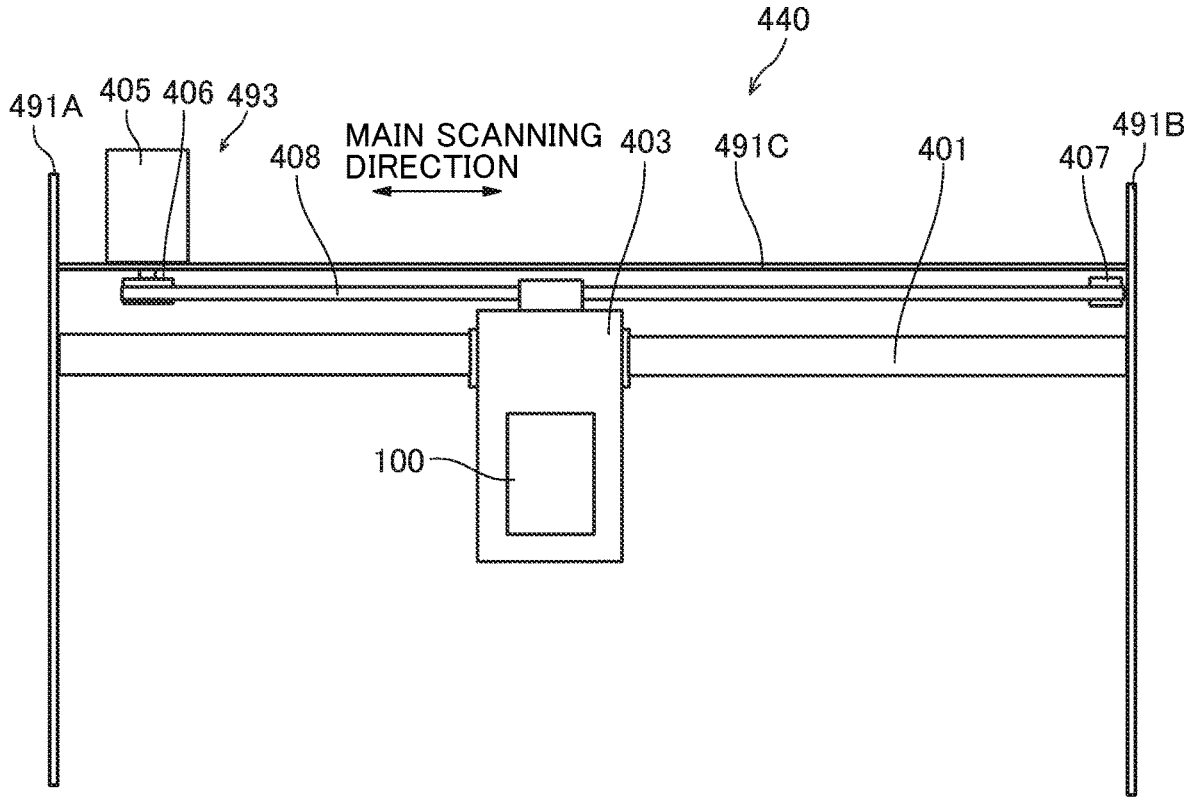
FIG. 11 is an explanatory plan view of a main part of another exemplary liquid discharge device according to the present disclosure.

Next, another exemplary liquid discharge device according to the present disclosure, will be described with reference to FIG. 11. FIG. 11 is an explanatory plan view of a main part of the liquid discharge device.

From the constituent members of the liquid discharge apparatus described above, a liquid discharge device 440 includes a casing including the side plates 491A and 491B and the back plate 491C, and the main scanning movement mechanism 493, the carriage 403, and the head 100.

Note that, for example, the maintenance mechanism 420 described above can be further attached to the side plate 491B of the liquid discharge device 440.

Thus, the head 100 and at least one of the head tank 441 to store liquid to be supplied to the head 100, the carriage 403 on which the head 100 is mounted, a supply mechanism (liquid circulation device 600, for example) to supply liquid to the head 100, the maintenance mechanism 420 to maintain the head 100, and the main scanning movement mechanism 493 to move the head 100 in the main scanning direction form the liquid discharge device as a single unit.

Figure 12:
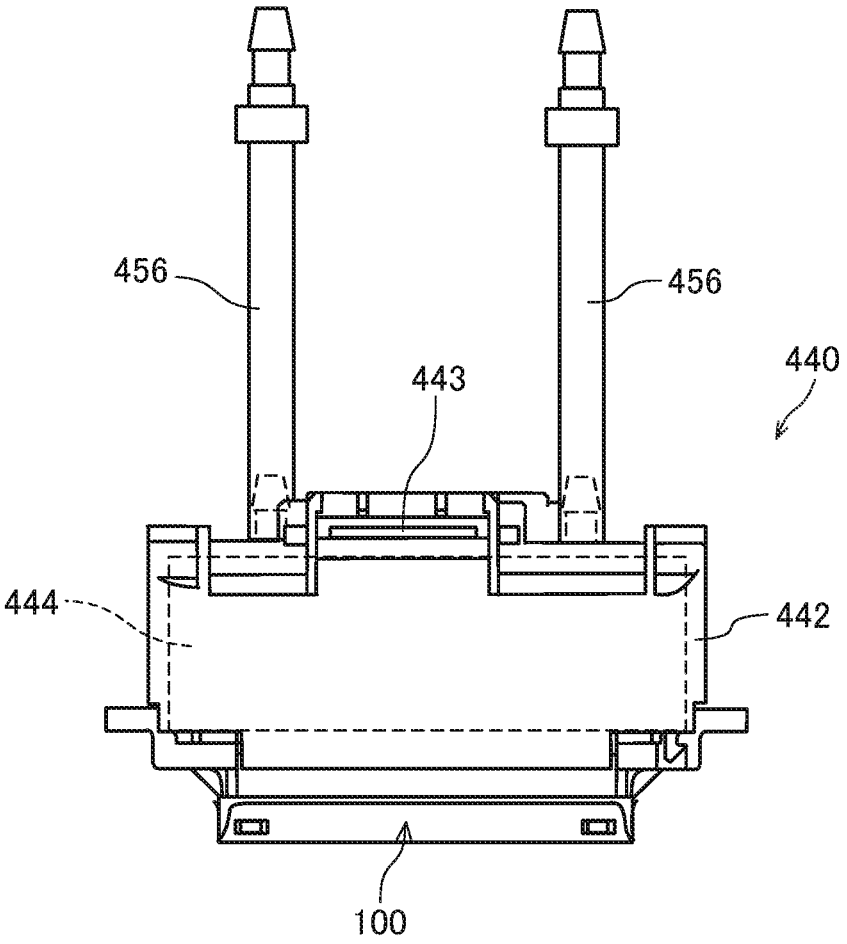
FIG. 12 is an explanatory front view of still another exemplary liquid discharge device according to the present disclosure.

Next, still another exemplary liquid discharge device according to the present disclosure, will be described with reference to FIG. 12. FIG. 12 is an explanatory front view of the liquid discharge device.

A liquid discharge device 440 includes a head 100 to which a channel component 444 is attached, and tubes 456 connected to the channel component 444.

Note that the channel component 444 is disposed inside a cover 442. A head tank 441 can be included instead of the channel component 444. A connector 443 that makes an electrical connection to the head 100, is provided at the upper portion of the channel component 444.

In the present application, liquid to be discharged is not particularly limited as long as the liquid has a viscosity or surface tension allowing the liquid to be discharged from the head. Preferably, the viscosity is not greater than 30 mPa·s under ordinary temperature and ordinary pressure or by heating or cooling. More specifically, examples of the liquid include a solution, a suspension, and an emulsion that contain a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for inkjet ink, surface treatment solution, a liquid for forming constituent elements of electronic element or light-emitting element or a resist pattern of electronic circuit, or a material solution for three-dimensional fabrication.

Examples of an energy generation source for discharging the liquid include a piezoelectric actuator (a laminated piezoelectric element or a thin-film piezoelectric element), a thermal actuator that employs an electrothermal conversion element, such as a heating resistor, and an electrostatic actuator including a diaphragm and opposed electrodes.

The "liquid discharge device" includes the liquid discharge head integrated with a functional component or mechanism. An example of the "liquid discharge device" is an assembly of components relating to liquid discharge. For example, the "liquid discharge device" includes a combination of the liquid discharge head with at least one of a head tank, a carriage, a supply mechanism, a maintenance mechanism, a main scanning movement mechanism, and a liquid circulation device.

Here, examples of the integration include mutually securing of the liquid discharge head and the functional component or mechanism through fastening, bonding, or engaging, and movably retention of one to the other. The liquid discharge head and the functional component or mechanism may be provided mutually detachably.

For example, as the liquid discharge device, provided is the integration of the liquid discharge head with the head tank. For the integration, the liquid discharge head and the head tank are connected mutually through a tube. Here, a unit including a filter can be added between the head tank and the liquid discharge head of the liquid discharge device.

As the liquid discharge device, provided is the integration of the liquid discharge head with the carriage.

As the liquid discharge device, provided is the integration of the liquid discharge head with the main scanning movement mechanism, in which the liquid discharge head is retained movably by a guide member included in part of the main scanning movement mechanism. Provided is the integration of the liquid discharge head, the carriage, and the main scanning movement mechanism.

As the liquid discharge device, provided is the integration of the liquid discharge head, the carriage, and the maintenance mechanism, in which a cap member included in part of the maintenance mechanism is secured to the carriage having the liquid discharge head attached.

As the liquid discharge device, provided is the integration of the liquid discharge head and the supply mechanism, in which a tube is connected to the liquid discharge head having the head tank or a channel component attached. Through the tube, the liquid in a liquid storage source is supplied to the liquid discharge head.

The main scanning movement mechanism includes the guide member as a single body. The supply mechanism includes the tube as a single body and a loader as a single body.

An example of the "liquid discharge apparatus" is an apparatus including the liquid discharge head or the liquid discharge device, the apparatus being to drive the liquid discharge head to discharge the liquid. Examples of the liquid discharge apparatus include an apparatus capable of discharging liquid to an object to which the liquid can adhere, and an apparatus that discharges liquid into gas or liquid.

The "liquid discharge apparatus" can include not only units involved in feeding, conveyance, and paper ejection of the object to which liquid can adhere, but also a preprocessing device and a postprocessing device.

Examples of the "liquid discharge apparatus" include: an image forming apparatus that discharges ink to form an image on a paper sheet; and a solid fabrication apparatus (three-dimensional fabrication apparatus) that discharges a fabrication liquid to a powder layer including powder formed in layers in order to fabricate a solid fabrication object (three-dimensional fabrication object).

The "liquid discharge apparatus" is not limited to visualization of a meaningful image including a character or a figure, with the discharged liquid. For example, formation of a pattern having no meaning and shaping of the pattern to a three-dimensional image, are included.

The "object to which liquid can adhere" described above means an object to which liquid can adhere at least temporarily, the liquid being to adhere to and to fix on the object or to adhere to and to permeate the object. Specific examples include recording media, such as a paper sheet, recording paper, a recording paper sheet, film, and cloth, electronic components, such as an electronic substrate and a piezoelectric element, and media, such as a powder layer (granular layer), an organ model, and a testing cell. Unless otherwise particularly limited, any object to which liquid adheres, is included.

The material of the "object to which liquid can adhere" may be any material, such as paper, thread, fiber, fabric cloth, leather, metal, plastic, glass, wood, or ceramics as long as liquid can adhere to at least temporarily.

The "liquid discharge apparatus" may be, but is not limited to, an apparatus that relatively moves the liquid discharge head and the object to which liquid can adhere. Specific examples include a serial head apparatus that moves the liquid discharge head and a line head apparatus that does not move the liquid discharge head.

Further examples of the "liquid discharge apparatus" include a treatment liquid coating apparatus that discharges a treatment liquid onto a paper sheet in order to coat the treatment liquid on the surface of the paper sheet for reforming of the surface of the paper sheet, and an injection granulation apparatus that sprays a composition liquid including raw material dispersed in a solution, through a nozzle, to granulate fine particles of the raw material.

Note that the terms "image formation", "recording", "character printing", "image printing", "printing", and "shaping" are used as a synonym in the present application.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a nozzle plate including a plurality of nozzles to discharge liquid;

a plurality of individual chambers communicating with the plurality of nozzles, respectively;

a plurality of individual collection channels communicating with the plurality of individual chambers, respectively;

a supply-side common channel communicating with the plurality of individual chambers; and a collection-side common channel communicating with the plurality of individual collection channels, wherein the collection-side common channel includes a first channel arranged in a first direction along a surface of the nozzle plate;

a second channel communicating with the first channel, the second channel arranged in a second direction across the surface of the nozzle plate; and a branch channel branched from the first channel and connected to the second channel, the branch channel arranged in a third direction across the surface of the nozzle plate; and the plurality of individual chambers overlap the plurality of individual collection channels in the second direction.

2. The liquid discharge head according to claim 1, wherein the branch channel includes:

a first branch channel arranged in the third direction to be connected to the first channel; and a second branch channel to connect the first branch channel and the second channel.

3. The liquid discharge head according to claim 2, wherein the second direction and the third direction are orthogonal to the first direction; and the second branch channel is arranged in the first direction.

4. The liquid discharge head according to claim 1, wherein the branch channel is inclined obliquely upward from the first channel to the second channel.

5. The liquid discharge head according to claim 1, wherein the branch channel is inclined obliquely upward from the first channel to the second channel.

6. A liquid discharge device comprising the liquid discharge head according to claim 1.

7. The liquid discharge device according to claim 6, wherein the liquid discharge head and at least one of a head tank to store liquid to be supplied to the liquid discharge head, a carriage on which the liquid discharge head is mounted, a supply mechanism to supply liquid to the liquid discharge head, a maintenance mechanism to maintain the liquid discharge head, and a main scanning movement mechanism to move the liquid discharge head in a main scanning direction form the liquid discharge device as a single unit.

8. A liquid discharge apparatus comprising the liquid discharge device according to claim 6.

9. The liquid discharge head of claim 1, wherein, for a given nozzle, a first distance in the first direction from the branch channel to a location of the nozzle is greater than a second distance in the first direction from the supply-side common channel to the location of the nozzle.

10. The liquid discharge head of claim 1, wherein, for a given nozzle, the supply-side common channel is located between a location of the nozzle and a location of the branch channel in the first direction.

* * * * *